US005769254A

United States Patent [19]

King et al.

[11] Patent Number: 5,769,254

[45] Date of Patent: Jun. 23, 1998

[54] CONTAINER AND CLOSURE WITH ALIGNABLE HANDLE

[75] Inventors: Roger Milner King, Bucks; Roger Edwin Powell, Norfolk; Rodney George Offley, Leicestershire, all of England

[73] Assignee: Beeson and Sons Limited, Herts, United Kingdom

[21] Appl. No.: 486,041

[22] Filed: Jun. 7, 1995

Related U.S. Application Data

[63] Continuation of Ser. No. 66,546, May 24, 1993, Pat. No. 5,454,476, which is a continuation of Ser. No. 706,891, May 29, 1991, Pat. No. 5,213,225.

[30] Foreign Application Priority Data

May 30, 1990 [GB] United Kingdom ..... 9012041

[51] Int. Cl.[6] ..... B65D 41/04

[52] U.S. Cl. ..... 215/330; 215/228; 215/305; 215/329; 215/331; 220/212.5; 220/751

[58] Field of Search ..... 215/211, 214–216, 215/218, 222, 227, 228, 302–303, 305, 317, 329–331, 339, 399; 220/212.5, 751–752, 755

[56] References Cited

U.S. PATENT DOCUMENTS

| | | | |
|---|---|---|---|
| D. 207,887 | 6/1967 | Parsisson . | |
| D. 327,644 | 7/1992 | Offley et al. . | |
| D. 329,980 | 10/1992 | Powell et al. . | |
| 3,240,384 | 3/1966 | Lermer . | |
| 3,370,733 | 2/1968 | Giesler | 215/399 X |
| 3,684,116 | 8/1972 | Duffy | 215/211 |
| 3,770,153 | 11/1973 | Gach et al. . | |
| 3,811,589 | 5/1974 | Thornton et al. | 215/225 |
| 3,831,797 | 8/1974 | Stevens, Jr. . | |
| 3,894,647 | 7/1975 | Montgomery . | |
| 3,917,097 | 11/1975 | Uhlig . | |
| 3,923,180 | 12/1975 | Fields | 215/216 |
| 3,924,769 | 12/1975 | Fillmore . | |
| 3,941,268 | 3/1976 | Owens et al. . | |
| 3,944,101 | 3/1976 | Landen . | |

(List continued on next page.)

FOREIGN PATENT DOCUMENTS

| | | | |
|---|---|---|---|
| 0 117 948 | 9/1984 | European Pat. Off. . | |
| 0 179 706 | 2/1988 | European Pat. Off. . | |
| 2036272 | 12/1970 | France . | |
| 2 558 443 | 7/1985 | France . | |
| 2 572 369 | 5/1986 | France . | |
| 261370 | 4/1927 | United Kingdom . | |
| 1 582 111 | 12/1980 | United Kingdom . | |
| 2 100 236 | 12/1982 | United Kingdom . | |
| 2 159 801 | 12/1985 | United Kingdom . | |
| 2 163 732 | 3/1986 | United Kingdom . | |
| WO90/04546 | 5/1990 | WIPO . | |
| 3,984,021 | 10/1976 | Uhlig . | |
| 3,993,209 | 11/1976 | Julian . | |
| 4,019,638 | 4/1977 | Miller | 215/399 X |

*Primary Examiner*—Stephen Cronin
*Attorney, Agent, or Firm*—Brinks Hofer Gilson & Lione

[57] ABSTRACT

A container neck (14) and a container closure comprises a first thread (15) on one of the neck and the closure, a complementary second thread on the other of the neck and the closure such that the closure is moveable from fully disengaged from the neck to fully closed by turning the closure relative to the neck by less than 360°, at least one stop formation (17,18) carried by said one of the neck (14) and the closure, and stop means on said other of the neck and the closure engageable with the stop formation or at least one of the stop formations to hold the closure in a closed position on the neck. The arrangement of the at least one stop formation (17,18), the stop means and the threads is such that the stop means is rotated past the stop formation or at least one of the stop formations (17,18) without engagement therewith when the closure is screwed on to the neck, engagement of the stop means with the stop formation or at least one of the stop formations commencing only when the closed positioned is neared.

54 Claims, 4 Drawing Sheets

U.S. PATENT DOCUMENTS

| | | | |
|---|---|---|---|
| 4,093,096 | 6/1978 | Augros . | |
| 4,134,513 | 1/1979 | Mumford . | |
| 4,138,028 | 2/1979 | Price et al. . | |
| 4,213,534 | 7/1980 | Montgomery . | |
| 4,273,248 | 6/1981 | Lehmann . | |
| 4,289,248 | 9/1981 | Lynn . | |
| 4,310,101 | 1/1982 | Sekine . | |
| 4,376,497 | 3/1983 | Mumford . | |
| 4,383,618 | 5/1983 | Dougherty . | |
| 4,386,712 | 6/1983 | DeWallace . | |
| 4,387,817 | 6/1983 | Wiles et al. . | |
| 4,387,822 | 6/1983 | Lynn . | |
| 4,413,743 | 11/1983 | Summers . | |
| 4,469,235 | 9/1984 | Parker . | |
| 4,494,655 | 1/1985 | Lehmann . | |
| 4,662,530 | 5/1987 | Goncalves et al. . | |
| 4,669,624 | 6/1987 | Wiles et al. . | |
| 4,770,308 | 9/1988 | Lynn . | |
| 4,913,299 | 4/1990 | Petro . | |
| 4,934,547 | 6/1990 | Mayes et al. . | |
| 5,147,052 | 9/1992 | Minette . | |
| 5,160,057 | 11/1992 | Fitjer | 215/331 X |
| 5,184,740 | 2/1993 | Mandrell, II et al. | 215/305 X |
| 5,213,225 | 5/1993 | King et al. . | |
| 5,219,084 | 6/1993 | King . | |
| 5,246,127 | 9/1993 | Purcell . | |
| 5,255,815 | 10/1993 | Renk et al. | 220/323 |
| 5,411,157 | 5/1995 | King et al. . | |
| 5,454,476 | 10/1995 | King et al. | 215/330 |

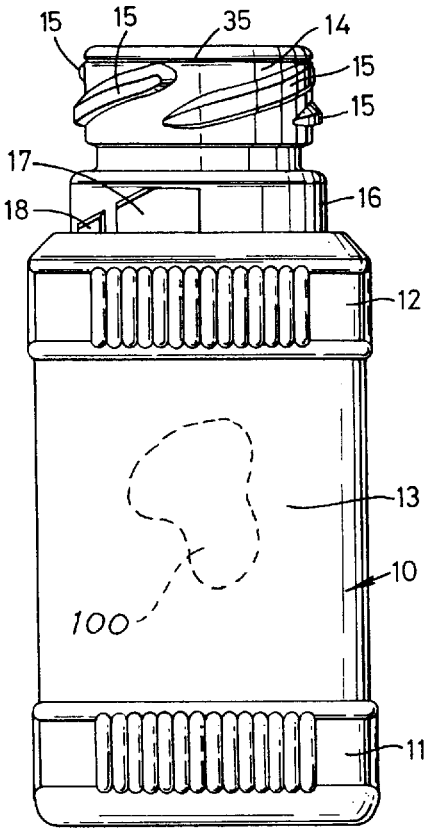
Fig. 1
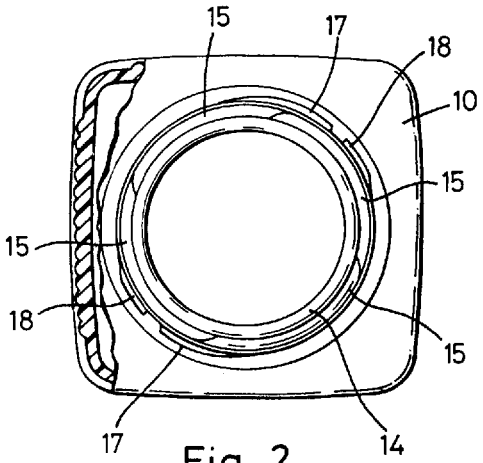
Fig. 2
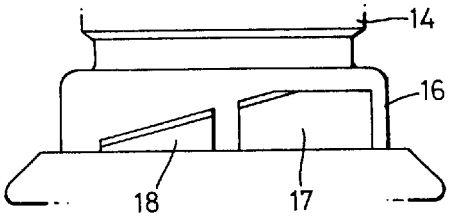
Fig. 3
Fig. 4
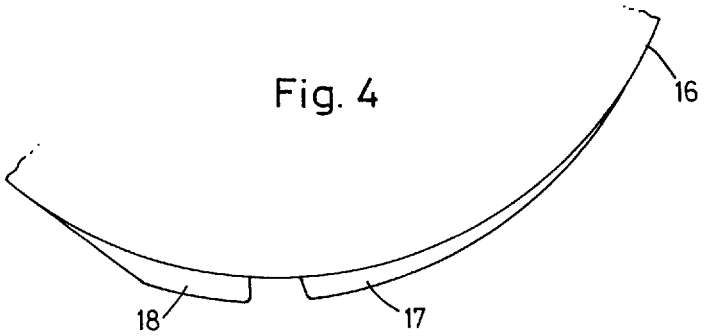

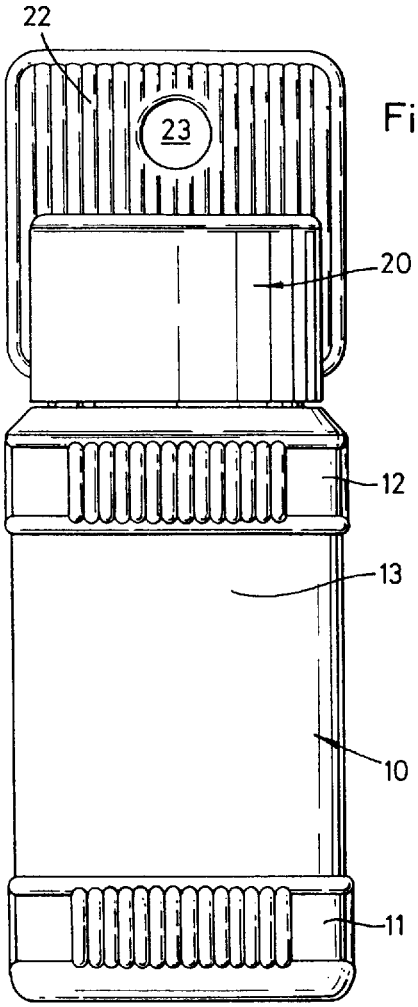
Fig. 10
Fig. 11
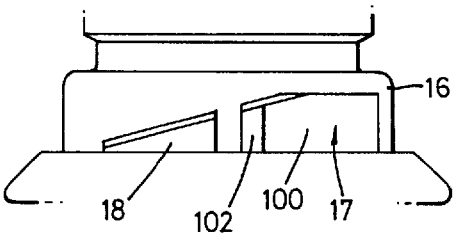
Fig. 12
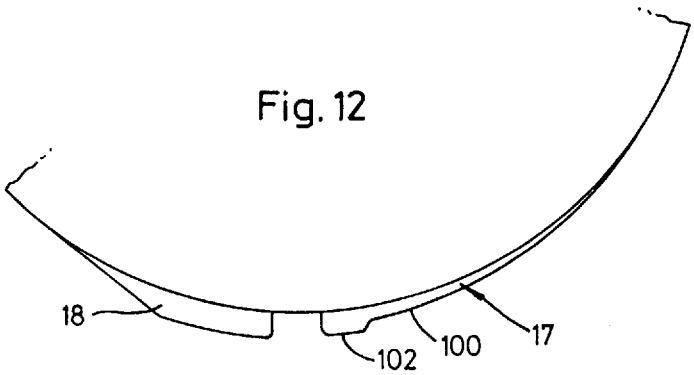

CONTAINER AND CLOSURE WITH ALIGNABLE HANDLE

This is a application continuation of application number 08/066,546, filed May 24,1993, now U.S. Pat. No. 5,454,476, which is a continuation of application Ser. No. 07/006,891, filed May 29, 1991, now U.S. Pat. No. 5,213,225.

BACKGROUND OF THE INVENTION

1. Field of the Invention

This invention relates to a container neck and a container closure, and also to a container and closure therefor.

2. Description of the Prior Art

Containers having closures are well known and have a wide variety of uses. For example, they may contain medicines or pharmaceuticals. They may contain drinks, such as carbonated or non-carbonated water, colas and the like, or wines or spirits (e.g. gin or whisky). Again they may contain petrol, oil, or household preparations or chemicals such as hair care products, detergents, bleaches and the like. The present invention is applicable to all of these areas of use and many others besides.

The conventional containers mostly have simple screw closures, which suffer from various disadvantages. For example, the closures are difficult for elderly or infirm people to operate because quite a significant torque is required and because the closure needs to be turned through more than one revolution relative to the container either to remove the closure or to replace it.

If the container is a container, for serving drinks it may be difficult for the user to seal it satisfactorily. On the one hand, the user may under-tighten the closure on the container (and thus not create an effective seal between container and closure), in which case the drink would not retain its original quality. A soft drink or still wine would not stay fresh; a carbonated beverage, sparkling wine or champagne would lose its fizziness, and spirits would evaporate. On the other hand, if the user over-tightened the closure, the closure would be difficult to unscrew again.

A similar sealing problem also arises with containers for other liquids. If the user under-tightened the closure, the liquid might evaporate (e.g. petrol), give off odorous or harmful vapours (e.g. oil or certain hazardous chemicals), or become contaminated. Again, if the user over-tightened the closure, the closure would be difficult to unscrew.

SUMMARY OF THE INVENTION

According to one aspect of the present invention, there is provided a container neck and a container closure comprising a first thread on one of the neck and the closure, a complementary second thread on the other of the neck and the closure such that the closure is moveable from fully disengaged from the neck to fully closed by turning the closure relative to the neck by less than 360°, at least one stop formation carried by said one of the neck and the closure, and stop means on said other of the neck and the closure engageable with the stop formation or at least one of the stop formations to hold the closure in a closed position on the neck, the arrangement of the or each stop formation, the stop means and the threads being such that the stop means is rotated past the stop formation or at least one of the stop formations without engagement therewith when the closure is screwed on to the neck, engagement of the stop means with the stop formation or at least one of the stop formations commencing only when the closed position is neared.

Preferably, the or each formation is chamfered axially in the same sense as the first thread whereby engagement of the stop means with the stop formation or at least one of the stop formations commences only when the closed position is neared.

The axial chamfer on the at least one stop formation can allow it to be designed with a height which is on average greater than that achievable with an unchamfered design of stop formation, whilst still avoiding the stop means prematurely engaging with the stop formation during screwing of the closure onto the neck. This greater height can provide a more positive closing action.

Preferably, the axial chamfer on the at least one stop formation has the same or approximately the same pitch as the first thread.

Preferably, the neck has an opening and the at least one stop formation is located on the neck on the side of the first thread remote from the opening.

Preferably, the at least one stop formation comprises a respective pair of stop profiles defining a space therebetween for engagement by the stop means when the closure is closed on the neck. The stop profile of the at least one stop formation engaged by the stop means as the closed position is neared preferably comprises a ramp portion for progressive engagement by the stop means during closure, and a projection extending above the level of the ramp portion at its end adjacent the space defined by the pair of stop profiles. The projection is advantageously an axially extending rib.

Preferably, the closure is moveable from fully disengaged from the neck to fully closed by turning the closure relative to the neck by approximately 90°.

Preferably, the first and second threads each have four thread starts.

Preferably, the stop means comprise a plurality of axially extending ribs angularly spaced from one another. More preferably, the container neck and closure comprises four ribs spaced angularly at 90°, and two stop formations spaced angularly at 180°.

The at least one stop formation may be carried by the neck and may be located on the outside thereof.

Preferably, the closure has a skirt portion carrying the stop means, which skirt portion is sufficiently resilient to allow flexing and alteration of the shape of the skirt thereby creating a spring action as the stop formations and stop means on the neck and closure engage or disengage. The skirt may be cylindrical but capable of deforming temporarily to an oval section as the stop formations and stop means on the neck and closure approach full engagement, returning to a cylindrical section when such stop formations and stop means are fully engaged.

Preferably, the closure carries a sealing ring which is coaxial with the axis of rotation of the closure on the neck and is arranged to engage the inside of the neck to seal the container as the stop formations on the neck and closure engage.

The invention extends to a container comprising a container neck and closure as aforesaid wherein the container has a container portion of substantially rectangular section, from which container portion the neck extends, and the closure has a planar handle portion, the threads, stop formations and stop means ensuring that the handle portion lies parallel to one of the sides of the rectangle in the closed position.

It will be appreciated, of course, that in general the container need not be of rectangular section. It may (especially if used for containing carbonated drinks) be of substantially circular section or else of any other suitable cross-section. Even if the container is of circular section, it will be understood that the present invention can still ensure consistent orientational alignment of the container and closure, which can be useful, for example, if the container and/or closure carry labels.

In a closely related aspect, the invention provides a container and closure therefor, the container having a neck and an opening in the neck to allow material to be put into and taken out of the container, the neck carrying a first thread arrangement, the closure carrying a complementary second thread arrangement, one of the neck and closure carrying stop means, the other of the neck and closure carrying at least one pair of stop profiles defining a space therebetween for engagement by the stop means to hold the closure in a closed orientation on the neck, the closure carrying a sealing ring which is coaxial with the axis of rotation of the closure on the neck and is arranged to engage the inside of the neck to seal the container as the stop means engages with the pair or at least one of the pairs of stop profiles.

By this arrangement, an effective seal between container and closure can be consistently and easily effected. The cooperation of the stop means and stop profiles to stop the closure at a set orientation on the container can ensure that the closure is neither under-tightened onto the container (in which case an effective seal would not be established), nor over-tightened (in which case the closure would be difficult to unscrew again).

Preferably, the first and second thread arrangements each have at least three thread starts.

Preferably, the pitch of the first and second thread arrangements is such that the closure is moveable from fully disengaged from the neck to fully closed by turning the closure relative to the neck by less than 360°.

In another closely related aspect, the invention provides a container and closure therefor, the container 10 having a neck and an opening in the neck to allow material to be put into and taken out of the container, the neck carrying a first thread arrangement and the closure carrying a second complementary thread arrangement, one of the neck and closure carrying stop means, the other of the neck and closure carrying at least one pair of stop profiles defining a space therebetween for engagement by the stop means to hold the closure in a closed orientation on the neck, the pitch of the first and second thread arrangements being such that the closure is moveable from fully disengaged from the neck to fully closed by turning the closure relative to the neck by less than 360°, the first and second thread arrangements each having at least three thread starts.

The provision of at least three thread starts on the neck and closure can render the closure less prone to tilting and rocking when screwed onto the container neck than might be the case if only one or two thread starts were provided. This can afford a more positive and accurate engagement between the stop means and the pair or pairs of stop profiles.

Preferably, the closure carries a sealing ring which is coaxial with the axis of rotation of the closure on the neck and is arranged to engage the inside of the neck to seal the container as the stop means engages with the pair or at least one of the pairs of stop profiles. The provision of at least three thread starts on the neck and closure can afford a better sealing action than might be achievable with fewer thread starts due to the greater stability which they can provide.

Preferably, the sealing ring has an outer surface which engages the neck of the container more tightly the more the closure is drawn on to the neck.

Preferably, the closure is moveable from fully disengaged from the neck to fully closed by turning the closure relative to the neck by approximately 90°.

More preferably, the neck has four external threads each extending through 90°, and the closure has four internal threads.

The invention provides in another related aspect a closure for a container comprising a planar top and a cylindrical portion depending therefrom, the cylindrical portion having a thread carrying part extending from the top carrying internal threads for engagement with threads of a container and a skirt depending from the thread carrying part, the skirt being of a wall thickness thinner than the thread carrying part with locking means extending inwardly of the inner wall of the skirt, the most radially inward surface of the locking means lying further from the longitudinal axis of the closure than does the most radially outward surface of the thread carrying part of the closure.

In a further related aspect, there is provided according to the present invention a container comprising a container portion of a first cross sectional area and a neck of a second cross sectional area less than the first cross sectional area and a second container of less capacity than the container and capable of insertion into the container through the neck whereby the container can be used with the full container capacity or with a reduced capacity of the second container.

By way of example, one embodiment of a container according to the invention will now be described with reference to the accompanying drawings, in which:

BRIEF DESCRIPTION OF THE DRAWING

FIG. 1 is a side view of a container;

FIG. 2 is a plan view of the container of FIG. 1;

FIG. 3 is a detail of the container neck;

FIG. 4 is a plan view on an enlarged scale of a stop profile on the container neck;

FIG. 10 is a side view of a cap and container engaged;

FIG. 11 is a detail of an alternative embodiment of stop profile; and

FIG. 12 is a plan view on an enlarged scale of the alternative embodiment of stop profile.

DESCRIPTION OF THE PREFERRED EMBODIMENTS

Figure 5:
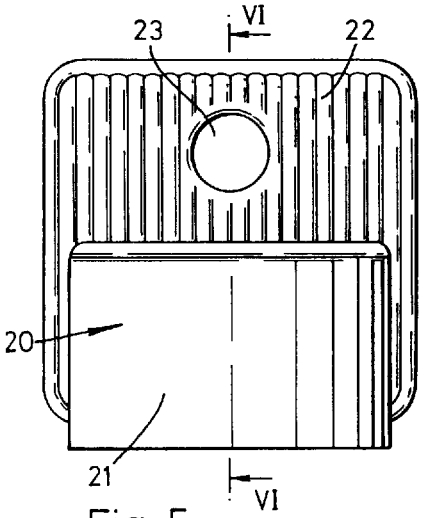
FIG. 5 is a side view of a cap for the container of FIGS. 1 to 4.
Figure 6:
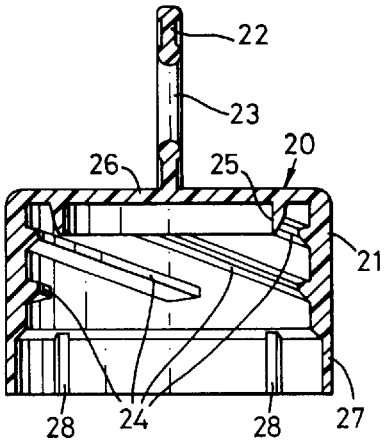
FIG. 6 is a sectional view along the lines VI-VI in FIG. 5.
Figure 7:
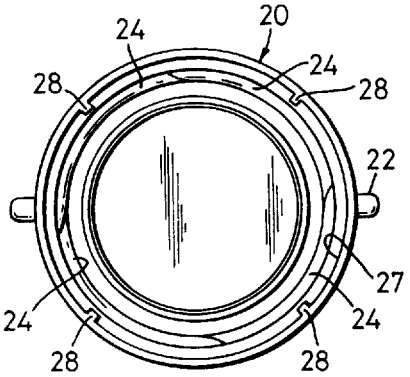
FIG. 7 is an underneath plan view of the cap of FIGS. 5 and 6.
Figure 9:
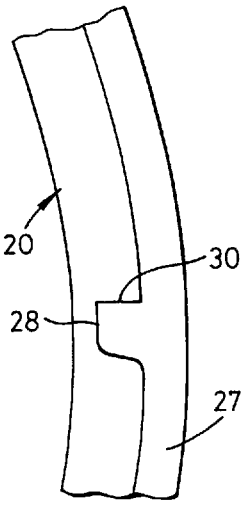
FIG. 9 shows a detail of a locking rib on the cap of FIGS. 5 to 7.
Figure 8:
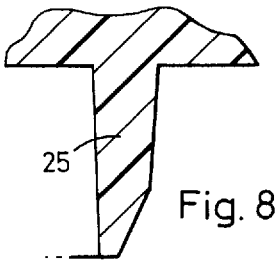
FIG. 8 is a sectional view on an enlarged scale of a sealing ring of the cap of FIGS. 5 to 7.

FIGS. 1 to 4 show a molded container 10 of moldable material, for example a polymer such as polyethylene. A variety of polymers could be used. Indeed, it will be appreciated that the container could be made of many alternative materials, such as glass (e.g. a drinks bottle) or metal (e.g. an oil can).

The container 10 has decoratively shaped portions 11 and 12 and a plain central portion 13 around which a label 100 may be affixed; a prime use for this particular shape and design of container is for holding pharmaceuticals. Note that the dashed lines of FIG. 1 schematically show label 100 and are not being used to indicate a particular shape for the label 100. Clearly, other shapes and designs of container would be appropriate for different uses. The container could be of circular section if it were employed for containing drinks; it could be a can if it were employed for containing motor car engine oil.

The container has a neck 14 carrying four threads 15 each extending around one quarter of the neck circumference, the neck 14 being tubular to provide an opening for allowing material into and out of the container.

A lower portion of the neck 14 has a shoulder portion 16 carrying two pairs of stop profiles, each pair of stop profiles having first and second stops 17 and 18 respectively. As can be seen in FIGS. 1 and 3, the axial profile of the stop profiles is tapered, and, as is shown in FIG. 4 in greater detail, the first and second stops 17 and 18 have different profiles when viewed axially. These profiles will be explained in more detail in connection with cooperation of the container with a cap as shown in FIGS. 5 to 9.

FIGS. 5 to 9 show a molded cap 20 of moldable material, for example a polymer such as polypropylene. The cap 20 is conveniently injection moulded. It will be appreciated that the cap could be made of alternative materials and by alternative processes.

The cap 20 has a hollow cylindrical closure portion 21 closed at the top for mating with the container 10, and a handle portion 22 for easy gripping manually. The handle portion 22 has a hole 23 to allow a container 10 to be hung from a peg, and to allow insertion of a member such as a pencil to increase leverage in case of need. Note that the lower arcuate portion of the hole 23 is considered to be an indent.

The internal cylindrical surface of the closure portion 21 has four internal threads 24 each extending around a quarter of the circumference of the cap 20, and matable with the threads 15 of the container 10. It will be appreciated that the threads need not extend around a quarter of the circumference of the cap, but could, for example, extend around a half of its circumference.

An internal sealing ring 25 extends from planar closure wall 26 towards the open end of the closure portion 21. The profile of the sealing ring 25 is shown on an enlarged scale in FIG. 8, which profile is tapered and provides a frictional fit seal with the rim of the container 10 at its top opening.

The closure portion 21 has a skirt 27 at its lower end, the skirt 27 being thinner than the wall of the remainder of the closure portion 21, thus giving the skirt more flexibility and ability to deform than has the remainder of the closure portion 21. The skirt 27 carries four axially extending locking ribs 28 equally spaced around the inner periphery of the skirt 27. Two ribs 28 cooperate with the pairs of stop profiles 17, 18 when the cap 20 is engaged on the container 10. The profile of a rib 28 is shown on an enlarged scale in FIG. 9, the rib 28 having a raked leading profile 29 with respect to the direction of cap engagement, and a radial trailing profile 30.

The action of the container and cap when putting on and taking off the cap is as follows:

The cap 20 is first placed over the container 10, with the closure portion 21 over the neck 14 of the container. The cap is then turned clockwise to engage the cap threads 24 with the neck threads 15. It will be appreciated that there are four possible thread engagement start positions, spaced apart by angles of 90°.

The cap 20 is rotated through 90° relative to the container 10 to full engagement. In the final part of the 90° movement, two opposed ribs 28 ride up respective first stop profiles 17, causing transformation of the cap skirt 27 into an oval shape, and then the ribs 28 fall into engagement between the stop profiles 17 and 18 of the respective pair, with the skirt springing back into a cylindrical shape. Each stop profile 17 has a softer profile than each stop profile 18, the latter presenting a square face to a respective rib 28 to prevent overturning.

As the cap 20 is drawn on to the container neck 14, the cap sealing ring 25 is drawn axially into the neck 14. The fact that the engagement is multi-threaded ensures that cap movement is axial with respect to the container 10 and that the sealing ring seats accurately onto the neck. The sealing ring 25 provides a tapered, frictional fit seal to give an air and liquid proof closure. It will be appreciated that the locking arrangement of ribs 28 and stop profiles 17 and 18 ensures that an effective seal is consistently achieved whilst preventing overtightening of the cap on the neck.

To remove the cap 20, the cap is unscrewed, initial unscrewing action causing the pair of engaged ribs 28 to ride over the stop profiles 17 to release the cap. It must be remembered that four ribs 28 are provided, such that for each start position there is a pair of ribs 28 to engage the pairs of stop profiles. However, to avoid action with the two ribs 28 which are not in operation, the axial profile of the stop profiles 17, 18 is chamfered, so that the nonengaging ribs pass axially clear of the stop profiles 17 and 18 on engagement and disengagement of the cap 20 and container 10. FIG. 3 shows the axially chamfered stop profiles 17 and 18.

It will be appreciated that the profiles of the ribs 28 and stop profiles 17, 18 can be altered, as can the skirt thickness, to vary the strength of the locking arising from engagement of the ribs 28 between the stop profiles 17 and 18. The stiffer the lock, the more difficult is engagement and disengagement; different strengths may be appropriate for different uses. It is also possible that the stop profiles could be formed inside the skirt 27, and the ribs outside the shoulder 16.

An alternative embodiment of stop profile 17 is shown in FIGS. 11 and 12. The stop profile 17 comprises a ramp portion 100 terminating in a rib 102 which extends axially across the width of the stop profile 17. The rib 102 serves to warn the user that the cap has been turned nearly to its fully closed position by requiring a discrete increase in torque for full closure to be effected. It also affords a more positive closing and opening action than can be obtained with a smooth tapered profile.

While a four start, quarter turn engagement has been described, other multi-start engagements may be used, utilising the same principle.

The skirt 27 is approximately one third of the thickness of the main body of the cap 20. This has an important implication in injection molding the cap 20, in that, when the cap is to be ejected from the mold, the female part of the mold can be unscrewed from the cap 20 without impinging on the four ribs 28, the inner surfaces of which lie on a circle of diameter greater than the internal diameter of the cap 20 in the region of the threads 24.

A liner (not shown) may be inserted into the container, after molding, through the neck 14. The liner would be cylindrical, to seal against the neck, and have a base to provide a container of volume less than the container 10. In this way, the container 10 can be used to contain different volumes, and the sleeve volume can be different, for example by making the sleeve in different lengths.

The container 10 has a drip fee lip provided by an annular recess 35 at the opening of the neck 14.

With four thread starts and a quarter turn to engage the cap 20 on the container 10, the handle portion will remain parallel to two essentially flat faces of the container 10 (see FIG. 10).

Figure 13:
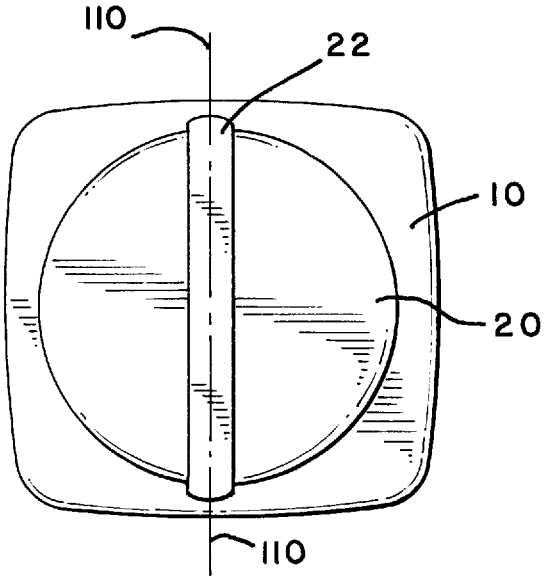
FIG. 13 is a top view of FIG. 10 showing the spatial orientation of the planar handle relative to the cross-section of the container when in a closed position.

Thus, the handle portion 22 lies within a plane that substantially defines a plane of symmetry 110 (dashed lines) of the rectangular cross-section of the container 10 when the closure portion 21 is in the closed position on the neck 14 (see FIG. 13).

This embodiment of an invention provides a container which is both easy to open, and which has a sufficiently strong lock for the closure on the neck to prevent difficulties (such as opening or spillage) during transport of the container, and to offer some resistance to children opening the container.

It will be appreciated that the foregoing description is by way of example only and that alterations or modifications may be made within the scope of the invention.

I claim:

1. A container assembly comprising:

a container comprising a container portion and a container neck extending from said container portion, said container portion comprising four sides and being of substantially rectangular cross-section and said container neck comprising a first thread;

a container closure comprising a planar handle portion and a second thread that mates with said first thread such that the closure is movable from fully disengaged from the neck to fully closed by turning the closure relative to the neck by an angle which is less than 360°;

at least one stop formation carried by said one of the neck and the closure; and a stop element on said other of the neck and the closure engagable with the at least one stop formation to hold the closure in a closed position on the neck, the arrangement of the at least one stop formation, the stop element and the first and second threads being such that the stop element is rotated past at least one stop formation without engagement therewith when the closure is screwed on to the neck, engagement of the stop element with the at least one stop formation commencing only when the closed position is neared, wherein the first and second threads, the at least one stop formation and the stop element ensure that said handle portion lies at said closed position within a plane that substantially defines a plane of mirror symmetry of said rectangular cross-section of said container portion so that for each and every point located in said rectangular cross-section there is a corresponding point in said rectangular cross-section that is located on the other side of said plane of mirror symmetry so that said plane of mirror symmetry is a perpendicular bisector of a linear line connecting the points when said handle portion lies within said plane that substantially defines said plane of mirror symmetry said planar handle portion provides a visual indication that said closure is in said closed position on said neck.

2. The container assembly of claim 1, wherein the closure is movable from fully disengaged from the neck to fully closed by turning the closure relative to the neck by an angle which is approximately 180°.

3. The container assembly of claim 1, wherein the closure is movable from fully disengaged from the neck to fully closed by turning the closure relative to the neck by an angle which is approximately 90°.

4. A container assembly comprising:

a container comprising a container portion and a container neck extending from said container portion, said container portion comprising four sides and being of substantially rectangular cross-section, said container neck carrying a first thread;

a container closure comprising a planar handle portion, said closure comprising a second thread that mates with said first thread so that said closure is movable from fully disengaged from said neck to fully closed by turning said closure relative to said neck through an angle which is less than 360°;

at least one stop formation carried by one of said neck and said closure, and at least one stop element on another of said neck and closure engagable with said stop formation to hold said closure in a closed position on said neck;

said closure being arranged such that when said closure is placed in said closed position on said neck, said planar handle portion of said closure lies within a plane that substantially defines a plane of mirror symmetry of said rectangular cross-section of said container portion so that for each every point located in said rectangular cross-section there is a corresponding point in said rectangular cross-section that is located on the other side of said plane of mirror symmetry so that said plane of mirror symmetry is a perpendicular bisector of a linear line connecting the points and so that when said handle portion lies within said plane that substantially defines said plane of mirror symmetry said planar handle portion provides a visual indication that said closure is in said closed position on said neck.

5. The container assembly of claim 4, wherein the closure is movable from fully disengaged from the neck to fully closed by turning the closure relative to the neck by an angle which is approximately 180°.

6. The container assembly of claim 4, wherein the closure is movable from fully disengaged from the neck to fully closed by turning the closure relative to the neck by an angle which is approximately 90°.

7. A container assembly comprising:

a container comprising a container portion and a container neck extending from said container portion, said container portion comprising four sides and being of substantially rectangular cross-section;

a container closure comprising a planar handle portion and a thread that mates with said container neck such that the closure is movable from fully disengaged from the neck to fully closed by turning the closure relative to the neck by an angle which is less than 360°;

at least one stop formation carried by said one of the neck and the closure; and a stop element on said other of the neck and the closure engagable with the at least one stop formation to hold the closure in a closed position on the neck, the arrangement of the at least one stop formation, the thread mating with the container neck and the stop element being such that the stop element is rotated past at least one stop formation without engagement therewith when the closure is screwed onto the neck, engagement of the stop element with the at least one stop formation commencing only when the closed position is neared;

wherein the thread mating with the container neck, the at least one stop formation and the stop element ensure that said handle portion lies at said closed position within a plane that substantially defines a plane of mirror symmetry of said rectangular cross-section of said container portion so that for each and every point located in said rectangular cross-section there is a corresponding point in said rectangular cross-section that is located on the other side of said plane of mirror symmetry so that said plane of mirror symmetry is a perpendicular bisector of a linear line connecting the points and so that when said handle portion lies within said plane that substantially defines said plane of symmetry said planar handle portion provides a visual indication that said closure is in said closed position on said neck.

8. The container assembly of claim 7, wherein the closure is movable from fully disengaged from the neck to fully closed by turning the closure relative to the neck by an angle which is approximately 180°.

9. The container assembly of claim 7, wherein the closure is movable from fully disengaged from the neck to fully closed by turning the closure relative to the neck by an angle which is approximately 90°.

10. A container assembly comprising:

a container having a container portion and a container neck extending from said container portion along a first direction, said container neck having an opening at one end thereof, a container closure having a thread that mates with said container neck such that the closure is movable from a fully disengaged position from the neck to fully closed by turning the closure relative to the neck by an angle which is less than 360°;

at least one stop formation carried by said one of the neck and the closure; and a stop element on said other of the neck and the closure engagable with the at least one stop formation to hold the closure in a closed position on the neck, the arrangement of the at least one stop formation, the stop element and the thread mating with the container neck being such that the stop element is rotated past at least one stop formation without engagement therewith when the closure is screwed on to the neck, engagement of the stop element with the at least one stop formation commencing only when the closed position is neared; and wherein the at least one stop formation engaged by the stop element as the closed position is neared comprises a respective pair of stop profiles defining a space therebetween for progressive engagement by said stop element when said closure is near said closed position wherein a portion of each of said stop profiles has a linear wedge-shaped chamfer along said first direction so that said stop element avoids engagement with said at least one stop formation until the closed position is neared.

11. The container assembly of claims 10, wherein the closure is movable from fully disengaged from the neck to fully closed by turning the closure relative to the neck by an angle which is approximately 180°.

12. The container assembly of claim 10, wherein the closure is movable from fully disengaged from the neck to fully closed by turning the closure relative to the neck by an angle which is approximately 90°.

13. The container assembly of claim 10, wherein at least one of said stop profiles comprises a ramp portion for progressive engagement by the stop element as the position is neared.

14. The container assembly according to claim 10, wherein said linear wedge shaped chamfer has a top side edge that is a distance from the opening that progressively increases as the closure moves from the fully disengaged position to the closed position.

15. The container assembly according to claim 10, wherein said at least one stop formation comprises a protuberance adjacent to said space.

16. A container assembly comprising:

a container having a container portion and a container neck extending from said container portion, said container portion having a side with a label, said container neck carrying a first thread;

a container closure having a planar handle portion, said closure comprising a second thread adapted to fit said first thread so that said closure is movable from fully disengaged from said neck to fully closed by turning said closure relative to said neck by an angle which is less than 360°;

at least one stop formation carried by said neck;

a stop element on said closure engagable with said or at least one stop formation to hold said closure in a closed position on said neck; and wherein said planar handle portion is positioned relative to said stop formation such that when said at least one stop formation and said stop element engage one another at said closed position said planar handle portion is consistently aligned relative to said container portion so as to provide a visual indication that said closure is in said closed position on said neck.

17. A container assembly according to claim 16, wherein said handle portion is aligned relative to said label when the closure is placed in said closed position.

18. A container assembly according to claim 16, wherein said stop element comprises an axially extending rib.

19. A container assembly according to claim 16, wherein said at least one stop formation comprises a pair of stop profiles defining a space therebetween for engagement by said stop element when said closure is in said closed position.

20. An assembly according to claim 16, wherein said at least one stop formation, said stop element, and said first and second threads are arranged such that said stop element is rotated past at least one stop formation without engagement therewith when said closure is screwed on to said neck, engagement of said stop means with said at least one stop formation commencing only when said closed position is neared.

21. An assembly according to claim 16, wherein said closure is moveable from fully disengaged from said neck to fully closed by turning said closure relative to said neck by no more than about 180°.

22. An assembly according to claim 16, wherein said closure is moveable from fully disengaged from said neck to fully closed by turning said closure relative to said neck by no more than about 90°.

23. An assembly according to claim 16, wherein said side has a circular cross-section.

24. A method of ensuring consistent alignment between a container and a closure when engaged at a closed position, wherein said container comprises a first thread and a stop element, and said closure comprises a planar handle portion and a neck with a second thread and a stop formation, said method comprising the steps of:

engaging said first thread with said second thread and rotating said closure relative to said container by an amount that is less than 360° until said closure nears said closed position;

engaging said stop formation and said stop element at said closed position to hold said closure in a closed position on said neck; and positioning said planar handle portion on said closure so that when said closure is at said closed position, said planar handle portion is aligned with a distinctive feature of said container and provides a visual indication that said closure is in said closed position on said neck.

25. The method of claim 24, wherein said closure is moveable from fully disengaged from said neck to fully closed by turning said closure relative to said neck by no more than about 180°.

26. The method of claim 24, wherein said closure is moveable from fully disengaged from said neck to fully closed by turning said closure relative to said neck by no more than about 90°.

27. The method of claim 24, comprising the step of engaging the stop element by a projection immediately prior to said stop element engaging said stop formation.

28. The method of claim 24, wherein said positioning step comprises aligning said handle portion relative to a label placed on said container.

29. The method of claim 28, wherein said container has a circular cross-section.

30. The method of claim 24, comprising the step of progressively engaging a ramp portion of said stop formation-by said stop element as the closed position is neared.

31. The method of claim 30, wherein said stop formation comprises a pair of stop profiles separated by a space, wherein a projection extends beyond the level of the ramp portion at its end adjacent the space defined by the pair of stop profiles.

32. The method of claim 24, wherein said container comprises a container portion of a substantially polygonal cross-section, and said positioning step comprises aligning said handle portion so that it lies within a plane that substantially defines a plane of mirror symmetry of said polygonal cross-section of said container portion so that for each and every point located in said rectangular cross-section there is a corresponding point in said polygonal cross-section that is located on the other side of said plane of mirror symmetry so that said plane of mirror symmetry is a perpendicular bisector of a linear line connecting the points.

33. The method of claim 32, wherein said closure is moveable from fully disengaged from said neck to fully closed by turning said closure relative to said neck by no more than about 180°.

34. The method of claim 32, wherein said closure is moveable from fully disengaged from said neck to fully closed by turning said closure relative to said neck by no more than about 90°.

35. The method of claim 32, wherein said polygonal cross-section comprises a rectangle.

36. The method of claim 24, wherein said container comprises a container portion of a substantially polygonal cross-section, and said positioning step comprises aligning said handle portion so that it lies parallel to a side of said polygonal cross-section of said container portion.

37. The method of claim 36, wherein said closure is moveable from fully disengaged from said neck to fully closed by turning said closure relative to said neck by no more than about 180°.

38. The method of claim 36, wherein said closure is moveable from fully disengaged from said neck to fully closed by turning said closure relative to said neck by no more than about 90°.

39. The method of claim 36, wherein said polygonal cross-section comprises a rectangle.

40. A container having a neck and a container closure comprising:

a first thread on said neck;

a second thread on said closure that mates with said first thread such that said closure is moveable from fully disengaged from said neck to fully closed by turning the closure relative to the neck by less than 360°;

at least one stop formation carried by said neck;

a stop element on said closure engagable with the stop formation to hold said closure in a closed position on said neck, wherein the arrangement of said at least one stop formation, the stop element and the first and second threads being such that said stop element is rotated past said at least one stop formation without engagement therewith when said closure is screwed on to said neck, and wherein engagement of said stop element with said at least one stop formation commencing only when the closed position is neared;

said at least one stop formation comprises a respective pair of stop profiles defining a space therebetween for engagement by said stop element when said closure is closed on said neck;

wherein at least one of said stop profiles comprises a ramp portion for progressive engagement by the stop element as the closed position is neared, and a projection extending beyond the level of the ramp portion at its end adjacent the space defined by the pair of stop profiles; and wherein said container comprises a container portion of substantially polygonal cross-section, and said container neck extends from said container portion, and wherein said closure comprises a planar handle portion, said thread mating with the container neck, the at least one stop formation and the stop element ensuring that said handle portion lies at said closed position within a plane that substantially defines a plane of mirror symmetry of said polygonal cross-section of said container portion so that for each and every point located in said polygonal cross-section there is a corresponding point in said polygonal cross-section that is located on the other side of said plane of mirror symmetry so that said plane of mirror symmetry is a perpendicular bisector of a linear line connecting the points and so that when said handle portion lies within said plane that substantially defines said plane of mirror symmetry said planar handle portion provides a visual indication that said closure is in said closed position on said neck.

41. The container of claim 40, wherein the closure is movable from fully disengaged from the neck to fully closed by turning the closure relative to the neck by an angle which is approximately 180°.

42. The container of claim 40, wherein the closure is movable from fully disengaged from the neck to fully closed by turning the closure relative to the neck by an angle which is approximately 90°.

43. The container of claim 40, wherein said handle portion comprises a hole therethrough to enable said container and closure to be hung by said handle portion on a peg, and to enable a lever member to be inserted through said hole to increase leverage should a person have difficulty in applying a torque to screw or unscrew said closure.

44. A container having a neck and a container closure comprising:

a first thread on said neck;

a second thread on said closure that mates with said first thread such that said closure is moveable from fully disengaged from said neck to fully closed by turning the closure relative to the neck by less than 360°;

at least one stop formation carried by said neck;

a stop element on said closure engagable with the stop formation to hold said closure in a closed position on said neck, wherein the arrangement of said at least one stop formation, the stop element and the first and second threads being such that said stop element is rotated past said at least one stop formation without engagement therewith when said closure is screwed on to said neck, and wherein engagement of said stop element with said at least one stop formation commencing only when the closed position is neared;

said at least one stop formation comprises a respective pair of stop profiles defining a space therebetween for engagement by said stop element when said closure is closed on said neck;

wherein at least one of said stop profiles comprises a ramp portion for progressive engagement by the stop element as the closed position is neared, and a projection extending beyond the level of the ramp portion at its end adjacent the space defined by the pair of stop profiles; and wherein said container has a container portion of substantially polygonal cross-section, and said container neck extends from said container portion, and wherein said closure has a planar handle portion, said thread mating with the container neck, the at least one stop formation and the stop element ensuring that said handle portion lies parallel to a side of said polygonal cross-section of said container portion so that when said handle portion lies parallel to said side of said polygonal cross-section said planar handle portion provides a visual indication that said closure is in said closed position on said neck.

45. The container of claim 44, wherein the closure is movable from fully disengaged from the neck to fully closed by turning the closure relative to the neck by an angle which is approximately 180°.

46. The container of claim 44, wherein the closure is movable from fully disengaged from the neck to fully closed by turning the closure relative to the neck by an angle which is approximately 90°.

47. The container of claim 44, wherein said planar handle portion comprises a hole therethrough to enable said container and closure to be hung by said handle portion on a peg, and to enable a lever member to be inserted through said hole to increase leverage should a person have difficulty in applying a torque to screw or unscrew said closure.

48. A container and closure, said container having a screw threaded container neck, and said closure comprising:

a first portion having an internal thread for engagement with said screw threaded neck such that said closure is movable from fully disengaged from said neck to fully closed by turning said closure relative to said neck through an angle of less than 360°;

a second portion comprising an upstanding generally planar handle portion;

wherein said upstanding generally planar handle portion comprises an indent therethrough that comprises a bottom portion to enable a lever member to be inserted through said indent to increase leverage should a person have difficulty in applying a torque to screw or unscrew said closure wherein said indent defines an edge that is entirely smooth; and at least on stop formation carried by one of said neck and said closure, and at least one stop element on another of said neck and closure engagable with said at least one stop formation to hold said closure in a closed orientation on said neck.

49. A container and closure according to claim 48, wherein said closure further comprises a skirt depending from said first portion, said skirt carrying said at least one stop element.

50. A container and closure according to claim 48, wherein said neck carries said at least one stop formation, and said at least one stop formation comprises a pair of stop profiles defining a space therebetween for engagement by said stop element when said closure is in said closed position on said neck.

51. A container and closure according to claim 48, wherein said closure is moveable from fully disengaged from said neck to fully closed by turning said closure relative to said neck by no more than about 180°.

52. A container and closure according to claim 48, wherein said closure is moveable from fully disengaged from said neck to fully closed by turning said closure relative to said neck by no more than about 90°.

53. A container and closure according to claim 48, wherein said container comprises a container portion of substantially polygonal cross-section, and said container neck extends from said container portion, and wherein said closure comprises a planar handle portion, said thread mating with the container neck, the at least one stop formation and the stop element ensuring that said handle portion lies within a plane that substantially defines a plane of mirror symmetry of said polygonal cross-section of said container portion when said closure is in said closed position on said neck so that for each and every point located in said polygonal cross-section there is a corresponding point in said polygonal cross-section that is located on the other side of said plane of mirror symmetry so that said plane of mirror symmetry is a perpendicular bisector of a linear line connecting the points.

54. A container and closure according to claim 48, wherein said container has a container portion of substantially polygonal cross-section, and said container neck extends from said container portion, and wherein said closure has a planar handle portion, said thread mating with the container neck, the at least one stop formation and the stop element ensuring that said handle portion lies within a plane that substantially defines a plane of symmetry of said polygonal cross-section of said container portion when said closure is in said closed position on said neck.

* * * * *